US007101321B2

(12) United States Patent
Kessler

(10) Patent No.: US 7,101,321 B2
(45) Date of Patent: Sep. 5, 2006

(54) JUMPING OR SKIPPING PLAYTHING

(75) Inventor: Brian D Kessler, Los Angeles, CA (US)

(73) Assignee: Maui Toys, Inc., Youngstown, OH (US)

( * ) Notice: Subject to any disclaimer, the term of this patent is extended or adjusted under 35 U.S.C. 154(b) by 375 days.

(21) Appl. No.: 10/677,296

(22) Filed: Oct. 3, 2003

(65) Prior Publication Data

US 2004/0097344 A1 May 20, 2004

Related U.S. Application Data

(60) Provisional application No. 60/422,879, filed on Nov. 1, 2002.

(51) Int. Cl.
*A63B 5/22* (2006.01)
*A63B 22/20* (2006.01)
*A63B 67/10* (2006.01)

(52) U.S. Cl. ..... 482/81; 446/26; 446/247

(58) Field of Classification Search ..... 482/44, 482/79, 81, 82, 92, 105, 110, 132, 148; 446/26, 446/247, 450–453, 241, 236; 473/424, 425, 473/427, 429, 506, 576
See application file for complete search history.

(56) References Cited

U.S. PATENT DOCUMENTS

| | | | | |
|---|---|---|---|---|
| 554,992 | A * | 2/1896 | Donnellan | 482/82 |
| 932,331 | A | 8/1909 | Russell et al. | |
| 1,189,307 | A | 7/1916 | Stokes et al. | |
| 1,333,005 | A * | 3/1920 | Warner | 482/110 |
| 3,075,767 | A * | 1/1963 | Ono | 482/82 |
| 3,110,493 | A | 11/1963 | Thompson | |
| 3,140,871 | A | 7/1964 | Liquori | |
| 3,165,315 | A | 1/1965 | Petrusek | |
| 3,410,554 | A * | 11/1968 | Harrison | 273/453 |
| 3,419,269 | A | 12/1968 | Saffer | |
| 3,528,654 | A | 9/1970 | Larson | |
| 3,589,719 | A | 6/1971 | Glass et al. | |
| 4,221,074 | A * | 9/1980 | Gonzalez | 446/28 |
| 4,480,831 | A | 11/1984 | Müller-Deinhardt | |
| 4,723,775 | A | 2/1988 | Stephens | |
| 4,875,675 | A | 10/1989 | Arad et al. | |
| 5,092,809 | A | 3/1992 | Kessler | |
| 5,597,159 | A * | 1/1997 | Haygood et al. | 473/424 |
| 5,603,651 | A | 2/1997 | Shure et al. | |
| 6,113,452 | A | 9/2000 | McGowan et al. | |
| 6,361,480 | B1 * | 3/2002 | Coram | 482/83 |
| D478,136 | S | 8/2003 | Chang | |
| 6,695,671 | B1 * | 2/2004 | Kessler | 446/247 |
| 2003/0027484 | A1 | 2/2003 | Kessler | |

FOREIGN PATENT DOCUMENTS

| | | |
|---|---|---|
| DE | 8522826 U1 | 10/1985 |
| GB | 1 390 477 | 4/1975 |
| GB | 1 400 005 | 7/1975 |
| WO | WO 03/011414 A1 | 2/2003 |

* cited by examiner

*Primary Examiner*—Jerome Donnelly
*Assistant Examiner*—Victor K. Hwang
(74) *Attorney, Agent, or Firm*—Browdy and Neimark, PLLC

(57) ABSTRACT

The jumping or skipping plaything has a flattened and twisted connector between a roller, drum or wheel at one end and an ankle ring at the other end. The connector rotates with the wheel or roller or drum relative to the ankle ring. The connector also contains day glow material to provide an edge glow.

20 Claims, 3 Drawing Sheets

JUMPING OR SKIPPING PLAYTHING

This application claims the benefit of U.S. provisional application No. 60/422,879, filed Nov. 1, 2002.

FIELD OF THE INVENTION

The present invention relates to an improvement in a game or amusement device particularly used by children for jumping or skipping, and having a ring through which one foot is placed, and whereby the user rotates the ring part of the device about the foot while hopping over an elongated element which extends from the ring.

BACKGROUND OF THE INVENTION

Devices of the above general type are known (e.g. Arad ET al U.S. Pat. No. 4,875,675; Liquori U.S. Pat. No. 3,140,871; Larson et al U.S. Pat. No. 3,528,654; McGowan et al U.S. Pat. No. 6,113,452; Shure et al U.S. Pat. No. 5,603,651), and these include the aforementioned ring at one end, the elongated element, e.g. a rope-like element, hereinafter referred to as a "connector" extending therefrom, and a wheel, e.g. for counting rotations, or roller element of the some type, at the opposite end of the connector from the ring. The roller or wheel provides both a weight at the opposite end of the connector so as to provide more efficient swinging of the device about the ankle of the user due to the effects of centrifugal force, and also in some devices rotates along the ground or other supporting surface on which the device is used, e.g. about an axis generally concentric with the connector.

The wheels or rollers of some of the prior devices are fixed to the end of connector so that the wheel or roller may rotate about the connector and along an axis at least parallel with and normally concentric with the axis of the connector.

SUMMARY OF THE INVENTION

The present invention is directed to an amusement device of the general type indicated above wherein special visual effects are created by providing a decorative connector which itself rotates relative to the ring and which, as it rotates, provides special visual effects.

BRIEF DESCRIPTION OF THE DRAWING

For a more complete understanding of the present invention, reference is now made to the following description of an embodiment of the invention taken in conjunction with the accompanying drawing figures in which.

DETAILED DESCRIPTION OF THE EMBODIMENT

Figure 1:
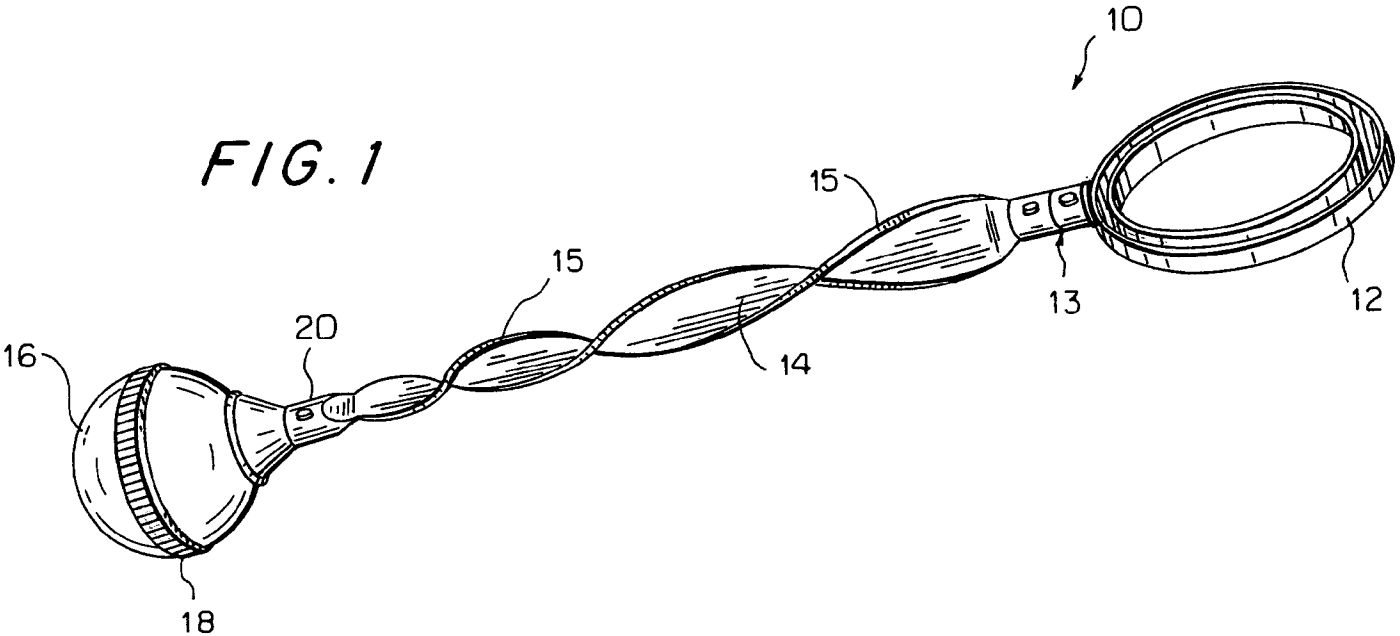
FIG. 1 is a perspective view of a device according to the present invention.
Figure 4:
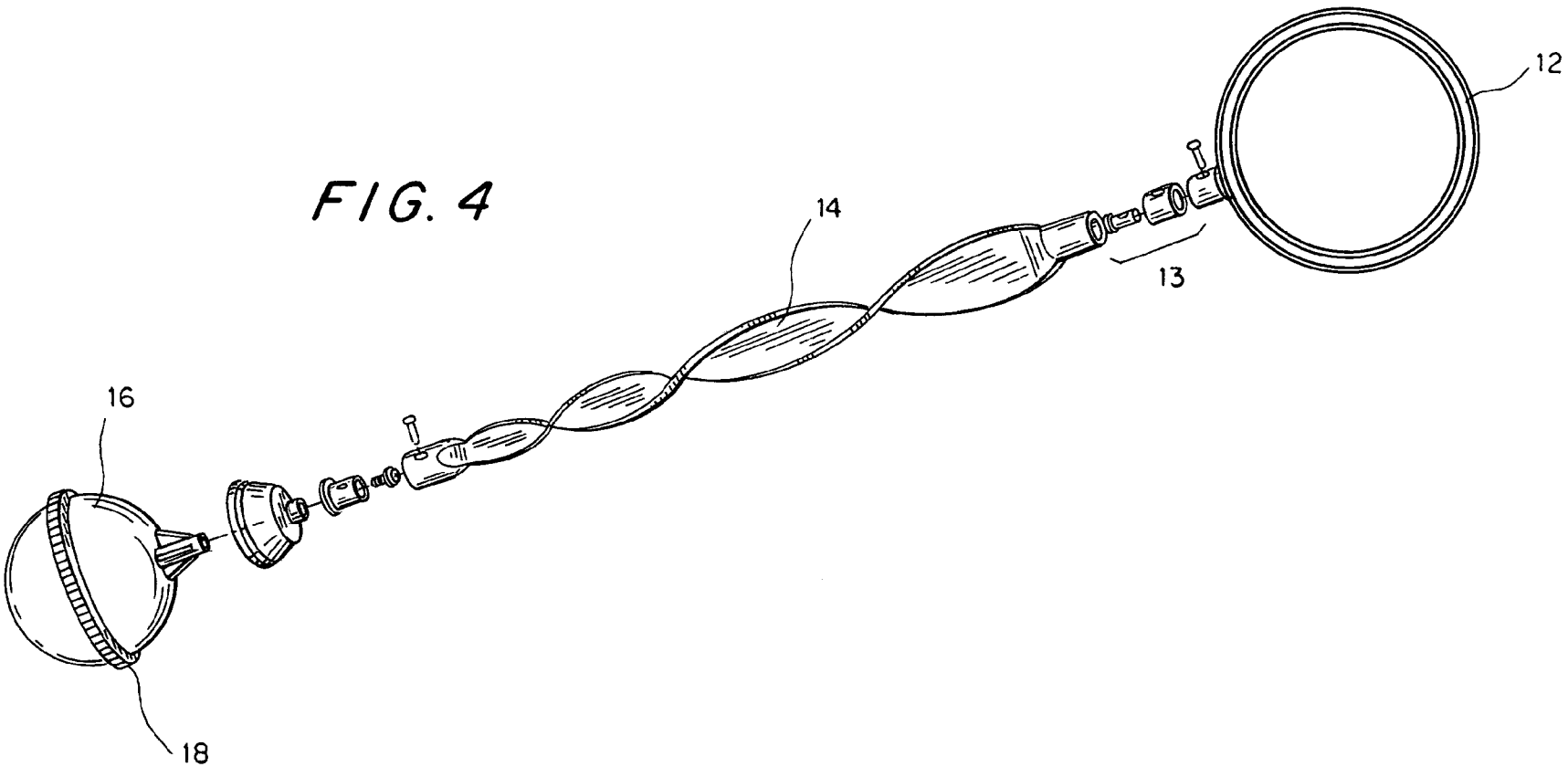
FIG. 4 is an exploded view of the device of FIG. 1.

An amusement device 10 according to the present invention comprises an ankle ring 12 through which one foot of the user is placed for rotation about the leg or ankle of the user, the ring 12 having a connector 14 extending therefrom as shown in FIGS. 1 and 4, the connector 14 being in the form of a twisted flattened plastic rod or narrow twisted sheet as described in more detail below. At the opposite end of the connector 14 there is mounted a ball 16 optionally having a rubber or PVC tread 18 or the like extending thereabout. A wheel, not shown, may be substituted for the ball 16.

Contrary to prior devices of the present type, a swivel or pivot section 13 is provided between the connector 14 and the ring 12, whereby the entire connector 14 is able to rotate as the ball 16 or wheel rotates and moves across the ground or floor, the connection 20 between the connector 14 and the ball 16 or wheel being preferably rigid or semi-rigid.

However, it is within the scope of the present invention to provide a second swivel or pivot at the joint 20 at the opposite end of the connector 14 whereby the ball 16 or wheel would rotate at a faster rate than rotation of the connector 14, i.e. in such an optional embodiment the pivot at connection 20 must be tighter or adapted to provide intermittent relative rotation so that, consistent with the main objective of the present invention, there will be at least a significant amount rotation of the connector 14 about the pivot section 13.

According to another aspect of the present invention, the connector 14 is a flattened element which is twisted or spiraled. The twisted connector 14 is desirably translucent or transparent and contains a fluorescent, phosphorescent or luminescent dye or pigment therewithin as disclosed in Kessler U.S. Pat. No. 5,092,809, incorporated herein by reference, so as to provide an edge glow effect, referred to in Kessler '809 as a "glowing" or "neon edge" appearance or quality. In one preferred embodiment, the flattened and twisted connector 14 has a width of about 4.5 cm and a thickness of about 4 mm.

Figure 3:
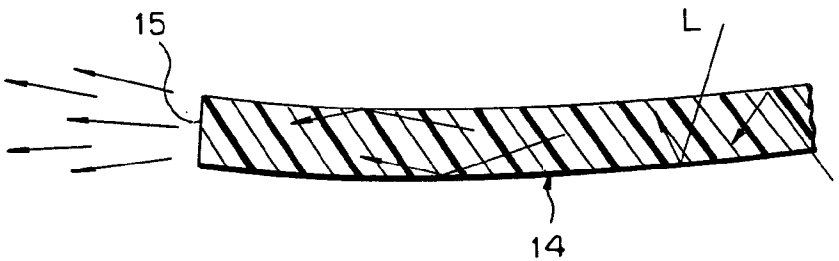
FIG. 3 is a partial cross-sectional view, partially schematic, taken through the connector element of the device of FIG. 1.

The transparent or translucent plastic from which the twisted connector 14 is formed thus contains such an appropriate fluorescent, luminescent, phosphorescent or "day glow" dye or pigment, hereinafter sometimes generally referred to as a "fluorescent dye" whereby the edges 15 of the twisted connector 14 have the ability to glow in the presence of light as indicated above, and as shown schematically in more detail in FIG. 3. Thus light L enters the side surfaces of the twisted connector rod 14 and is transmitted to the edges 15, producing a luminescent or iridescent or "neon edge" glowing effect very noticeable by and pleasing to the human eye. As the twisted connector rod 14 rotates about an axis through the pivot section 13, interesting visual patterns are produced.

Particularly if the flattened and twisted connector 14 is formed of transparent plastic, it may also contain metallic glitter flakes and/or pearlescent particles, known per se, incorporated therein during its molding, along with or in place of the aforementioned fluorescent dye. Preferably, however, the twisted or spiraled connector 14 contains both a fluorescent dye and decorative flakes or particles.

In an alternative embodiment, the flattened and twisted connector 14 is formed of an opaque plastic and is provided with different colors on opposite faces, e.g. red on one side and yellow on an opposite side, or blue and red on opposite sides, or red and white on opposite sides. As the twisted connector then rotates during use of the device, the effect is like a rotating barber's pole. Surface decoration may also be provided on other parts of the device 10.

Figure 2:
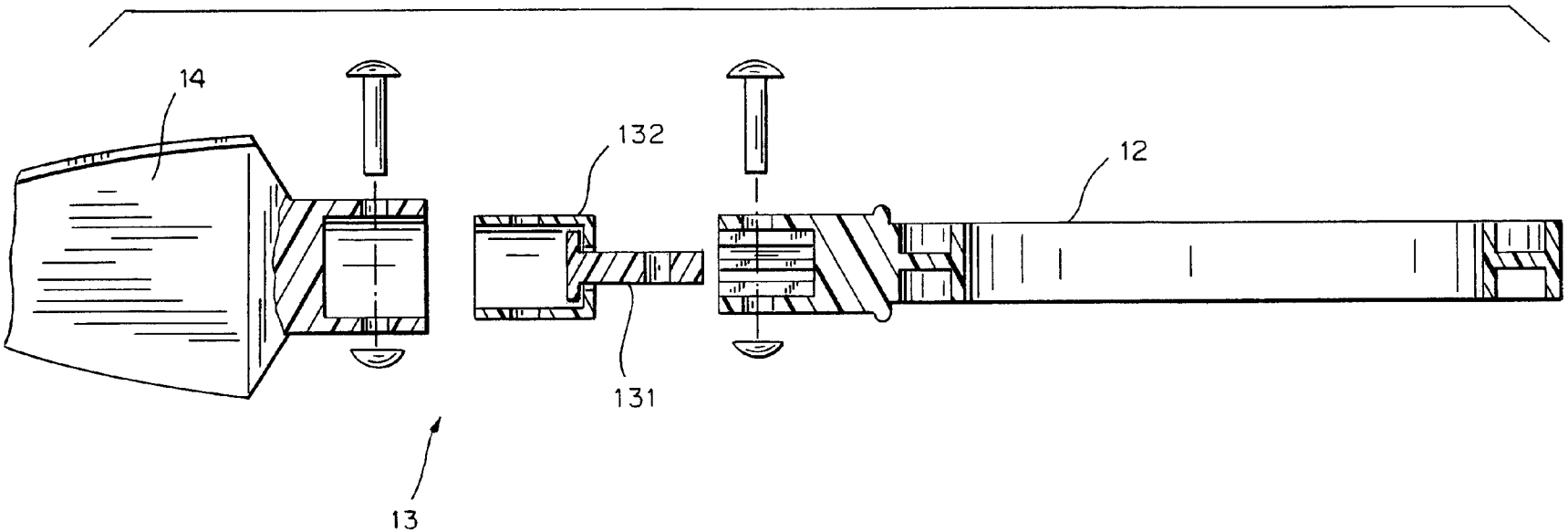
FIG. 2 is an exploded cross-sectional view of the device, partly broken away, showing the joint which connects the ring to the connector so as to permit rotation of the connector.

An important feature of the present invention is the pivot section 13 between the twisted connector 14 and the ankle ring 12, a preferred pivot section being shown in FIG. 2. Such pivot section must be sturdy, and at the same time permit free rotation of the twisted connector 14 and the ball 16. In the preferred embodiment as shown in FIG. 2 a strong plastic or metal pin 131 is riveted to the ankle ring 12, the pin 131 having a head, T-shaped in cross section, retained within a hollow pin head holder tube 132, U-shaped in cross section, in turn riveted to an end of the twisted connector 14. To further facilitate free rotation between the pin 131 and the pin head holder tube 132, a lubricant, e.g. a silicone grease or oil or the like, may also placed within the connector 132 adjacent the head of the pin 131.

The ring 12 and the ball 16 may be of conventional types such as shown, for example, in the aforementioned patents to Arad et al U.S. Pat. No. 4,875,675; Liquori U.S. Pat. No. 3,140,871; Larson et al U.S. Pat. No. 3,528,654; McGowan et al U.S. Pat. No. 6,113,452 and/or Shure et al U.S. Pat. No. 5,603,651, and may be formed of conventional materials consistent with such known prior art.

The twisted connector 14 is desirably formed of a strong and either rigid or slightly flexible plastic such as polycarbonate resin; polyethylene terephthalate (PET); opaque, transparent or translucent styrene-butadiene copolymer; or opaque, transparent or translucent plasticized vinyl resin. Other plastics may be tested for suitability in a routine fashion. However, the connector 14 must be relatively strong and flexible, so polycarbonate resin is preferred.

As indicated above, the pin 131 may be formed of metal or plastic, but is preferably formed of polyethylene. Similarly, the pin head holder tube 132 is also desirably made of polyethylene. Other plastics can also be selected, and alternative materials can be routinely tested for suitability.

The ball 16 is desirably made of ABS polymer, although other materials can also be used. The ball can be made transparent and contain glitter flakes, known per se. Alternatively, and as preferred, the ball is opaque and is provided with a decorative surface, either incorporated in the color of the plastic or as a surface coating.

The foregoing description of the specific embodiments will so fully reveal the general nature of the invention that others can, by applying current knowledge, readily modify and/or adapt for various applications such specific embodiments without undue experimentation and without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. The means, materials, and steps for carrying out various disclosed functions may take a variety of alternative forms without departing from the invention.

Thus the expressions "means to . . . " and "means for . . . ", or any method step language, as may be found in the specification above and/or in the claims below, followed by a functional statement, are intended to define and cover whatever structural, physical, chemical or electrical element or structure, or whatever method step, which may now or in the future exist which carries out the recited function, whether or not precisely equivalent to the embodiment or embodiments disclosed in the specification above, i.e., other means or steps for carrying out the same functions can be used; and it is intended that such expressions be given their broadest interpretation.

What is claimed is:

1. An entertainment device comprising an elongated connector having a first end and a second end, a ring at said first end and a rotatable element at the said second end of the elongated connector, said rotatable element at the second end of the elongated connector being adapted to rotate along a surface upon which the user is standing or hopping, wherein the elongated connector is rotatable relative to said ring, said elongated and rotatable connector is further provided with a configuration whereby different appearances occur as said elongated connector rotates relative to said ring; and wherein said elongated connector is a flattened and twisted element.

2. The device of claim 1, wherein said elongated connector is formed of a translucent or transparent plastic and contains one or both of a fluorescent dye and decorative flakes or particles.

3. The device of claim 2 wherein said elongated connector is formed of polycarbonate resin.

4. The device of claim 1 wherein said elongated connector is formed of polycarbonate resin.

5. The device of claim 1, wherein the elongated connector has a spiral configuration.

6. An entertainment device comprising an elongated connector having a first end and a second end, a ring at said first end and a rotatable element at the said second end of the elongated connector, wherein the elongated connector is rotatable relative to said ring, and said elongated and rotatable connector is further provided with a configuration whereby different appearances occur as said elongated connector rotates relative to said ring;

wherein said elongated connection is a flattened and twisted element; and wherein said elongated connector is formed of an opaque plastic and is provided with a different color on opposite faces thereof.

7. The device of claim 6 wherein said elongated connector is formed of polycarbonate resin.

8. An entertainment device comprising an elongated connector having a first end and a second end, a ring at said first end and a rotatable element at the said second end of the elongated connector, wherein the elongated connector is rotatable relative to said ring;

said elongated and rotatable connector is further provided with a configuration whereby different appearances occur as said elongated connector rotates relative to said ring;

said ring at said first end is adapted to rotate about an ankle of a user;

said rotatable element at said second end of the elongated connector is adapted to rotate along a surface upon which the user is standing or hopping; and the elongated and rotatable connector has a length which is substantially greater than the diameter of said ring;

wherein said elongated connector is a flattened and twisted element.

9. The device of claim 8, wherein said elongated connector is formed of a translucent or transparent plastic and contains one or both of a fluorescent dye and decorative flakes or particles.

10. The device of claim 9 wherein said elongated connector is formed of polycarbonate resin.

11. The device of claim 8, wherein said elongated connector is formed of an opaque strip plastic having opposite faces having a different colors thereon.

12. The device of claim 8 wherein said elongated connector is formed of polycarbonate resin.

13. The device of claim 8 wherein said elongated connector is a rod.

14. The device of claim 8 wherein said rotatable element at the second end of the elongated connector is a ball or a wheel.

15. The device of claim 8 wherein the rotatable element is connected to the rotatable connector so that the rotatable element rotates with the rotatable connector.

16. An entertainment device comprising an elongated connector having a first end and a second end, a ring at said first end and a rotatable element at the said second end of the elongated connector, wherein the elongated connector is rotatable relative to said ring, said elongated and rotatable connector is further provided with a configuration whereby different appearances occur as said elongated connector rotates relative to said ring;

wherein said elongated connector is a flattened and twisted element; wherein the ring at the first end of the elongated connector is of a generally circular configuration adapted to rotate around an ankle or lower part of a leg of a user thereof; and the rotatable element is connected to the rotatable connector so that the rotatable element rotates with the rotatable connector.

17. The device of claim 16, wherein said elongated connector is formed of a translucent or transparent plastic and contains one or both of a fluorescent dye and decorative flakes or particles.

18. The device of claim 16 wherein said rotatable element at the second end of the elongated connector is a ball or a wheel.

19. The device of claim 16, wherein the elongated connector is of unitary construction.

20. The device of claim 19, wherein the elongated connector has a spiral configuration.

* * * * *